US007997076B2

(12) United States Patent
Ernst

(10) Patent No.: US 7,997,076 B2
(45) Date of Patent: Aug. 16, 2011

(54) RANKINE CYCLE LOAD LIMITING THROUGH USE OF A RECUPERATOR BYPASS

(75) Inventor: Timothy C. Ernst, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 624 days.

(21) Appl. No.: 12/058,810

(22) Filed: Mar. 31, 2008

(65) Prior Publication Data

US 2009/0241543 A1 Oct. 1, 2009

(51) Int. Cl.

| | |
|---|---|
| ***F02G 3/00*** | (2006.01) |
| ***F02G 1/00*** | (2006.01) |
| ***F01K 13/00*** | (2006.01) |
| ***F01K 7/34*** | (2006.01) |
| ***F01K 9/00*** | (2006.01) |
| ***F01K 17/00*** | (2006.01) |
| ***F02C 1/00*** | (2006.01) |

(52) U.S. Cl. ..... 60/616; 60/645; 60/653; 60/661; 60/677; 60/772; 60/39.182; 60/39.52

(58) Field of Classification Search ..... 60/616, 60/670–671, 677, 645, 651, 653, 772, 661, 60/39.12, 39.182

See application file for complete search history.

(56) References Cited

U.S. PATENT DOCUMENTS

| | | | | |
|---|---|---|---|---|
| 3,232,052 | A * | 2/1966 | Pierre | 60/39.182 |
| 4,428,190 | A * | 1/1984 | Bronicki | 60/677 |
| 4,458,493 | A * | 7/1984 | Amir et al. | 60/662 |
| 4,831,817 | A * | 5/1989 | Linhardt | 60/39.12 |
| 6,301,890 | B1 * | 10/2001 | Zeretzke | 60/616 |
| 6,817,185 | B2 * | 11/2004 | Coney et al. | 60/772 |
| 6,986,251 | B2 | 1/2006 | Radcliff et al. | 60/671 |
| 7,007,487 | B2 * | 3/2006 | Belokon et al. | 60/777 |
| 2003/0213245 | A1 * | 11/2003 | Yates et al. | 60/651 |
| 2003/0213248 | A1 * | 11/2003 | Osborne et al. | 60/670 |
| 2008/0289313 | A1 * | 11/2008 | Batscha et al. | 60/772 |
| 2009/0151356 | A1 * | 6/2009 | Ast et al. | 60/653 |
| 2009/0211253 | A1 * | 8/2009 | Radcliff et al. | 60/670 |
| 2009/0320477 | A1 * | 12/2009 | Juchymenko | 60/651 |
| 2010/0018207 | A1 * | 1/2010 | Juchymenko | 60/670 |

FOREIGN PATENT DOCUMENTS

WO WO 2006138459 A2 * 12/2006

* cited by examiner

*Primary Examiner* — Thai Ba Trieu

(74) *Attorney, Agent, or Firm* — Studebaker & Brackett PC; Tim L. Brackett, Jr.; J. Bruce Schelkopf

(57) ABSTRACT

A system for converting heat from an engine into work includes a boiler coupled to a heat source for transferring heat to a working fluid, a turbine that transforms the heat into work, a condenser that transforms the working fluid into liquid, a recuperator with one flow path that routes working fluid from the turbine to the condenser, and another flow path that routes liquid working fluid from the condenser to the boiler, the recuperator being configured to transfer heat to the liquid working fluid, and a bypass valve in parallel with the second flow path. The bypass valve is movable between a closed position, permitting flow through the second flow path and an opened position, under high engine load conditions, bypassing the second flow path.

16 Claims, 1 Drawing Sheet

RANKINE CYCLE LOAD LIMITING THROUGH USE OF A RECUPERATOR BYPASS

The U.S. Government has a paid-up license in this invention and the right in limited circumstances to require the patent owner to license others on reasonable terms as provided for by the terms of (DE-FC26-05NT42419) awarded by (Dept. of Energy).

FIELD OF THE INVENTION

The present invention generally relates to waste heat recovery systems for engines, and more particularly to waste heat recovery systems including an organic Rankine cycle with a recuperator that may be bypassed to maintain desired engine cooling.

BACKGROUND OF THE INVENTION

In general, waste energy recovery systems for use with engines need to operate over a wide range of heat input, which varies depending upon the engine load, while maintaining acceptable performance under conditions of high fuel consumption. Various systems for adjusting system performance over a heat input range are known, such as those described in U.S. Pat. No. 6,986,251, for example.

SUMMARY OF THE INVENTION

In one embodiment of the invention, a system is provided for converting waste heat from an engine into work. The system generally includes a boiler coupled to a waste heat source for transferring heat to a working fluid, a turbine configured to receive the working fluid from the boiler and to transform heat in the working fluid into motive work, a condenser coupled to a low temperature source for transforming working fluid in a gaseous state into working fluid in a liquid state, a recuperator having a first flow path that routes gaseous working fluid from the turbine to the condenser, and a second flow path that routes liquid working fluid from the condenser to the boiler, the recuperator being configured to transfer heat from the gaseous working fluid to the liquid working fluid, and a bypass valve coupled between the condenser and the boiler in parallel with the second flow path, the bypass valve being movable between a closed position under normal engine load conditions, thereby permitting working fluid to flow through the second flow path instead of the bypass valve and an opened position under high engine load conditions, thereby permitting at least a portion of the working fluid to flow from the condenser to the boiler without flowing through the second flow path.

BRIEF DESCRIPTION OF THE DRAWINGS

The above-mentioned and other features of this invention and the manner of obtaining them will become more apparent and the invention itself will be better understood by reference to the following description of embodiments of the present invention taken in conjunction with the accompanying drawings, wherein.

Figure 1:
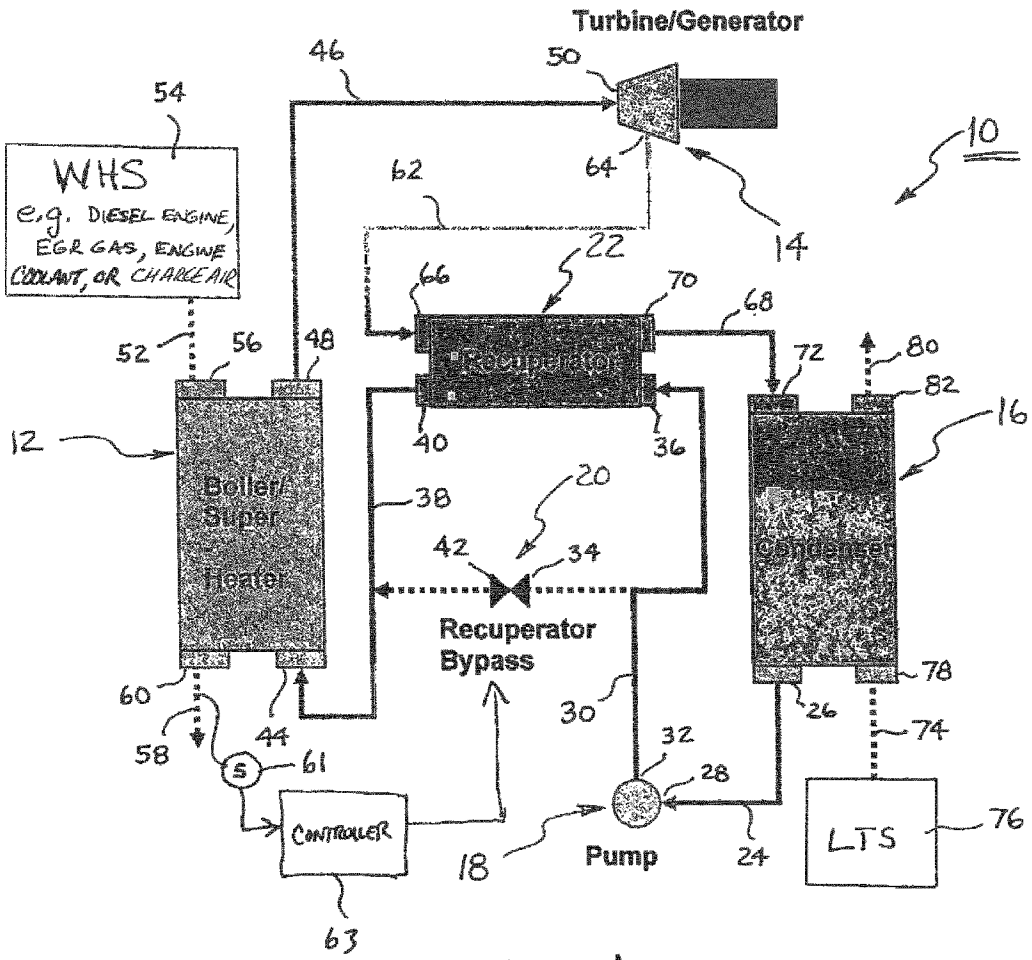
FIG. 1 depicts a general schematic diagram of portions of an exemplary waste heat recovery system embodying principles of the present invention.

Although the drawings represent embodiments of various features and components according to the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated device and described method and further applications of the principles of the invention, which would normally occur to one skilled in the art to which the invention relates. Moreover, the embodiments were selected for description to enable one of ordinary skill in the art to practice the invention.

As indicated above, the invention combines an organic Rankine cycle with a diesel engine to recover waste heat from the engine and convert the heat energy into motive work. FIG. 1 depicts an embodiment of a system according to the principles of the present invention. The system 10 generally includes a boiler (or super-heater) 12, a turbine 14 which may be connected to a generator (not shown), a condenser 16, a pump 18, a bypass valve 20, a recuperator 22, a sensor 61, and a controller 63.

As is further described below, a working fluid (such as R245fa, steam, Fluorinol, Toluene, water/methanol mixtures, etc.) is passed through system 10 through a series of conduits. Conduit 24 is connected between an outlet 26 of condenser 16 and an inlet 28 of pump 18. Conduit 30 is connected between an outlet 32 of pump 18, an inlet 34 of bypass valve 20, and an inlet 36 of recuperator 22. Conduit 38 is connected between an outlet 40 of recuperator 22, an outlet 42 of bypass valve 20, and an inlet 44 of boiler 12. Conduit 46 is connected between an outlet 48 of boiler 12 and an inlet 50 of turbine 14. Conduit 52 is connected between a waste heat source 54 and an inlet 56 of boiler 12. Waste heat source 54 may be any acceptable source of waste heat such as EGR gas, charge air, engine coolant, or engine exhaust. Conduit 58 is connected between an outlet 60 of boiler 12. Depending upon the nature of waste heat source 54, the waste heat exiting boiler 12 through conduit 58 may be delivered, for example, to the engine's EGR loop, the vehicle exhaust system, the charge air loop, or the engine coolant loop.

As is further described below, temperature sensor 61 is coupled to conduit 58 to detect the temperature of the waste heat exiting boiler 12, and provide an output signal to controller 63 which controls the position of bypass valve 20. Conduit 62 is connected between a diffuser outlet 64 of turbine 14 and an inlet 66 of recuperator 22. Conduit 68 is connected between an outlet 70 of recuperator 22 and an inlet 72 of condenser 16. Conduit 74 is connected between a low temperature source 76 and an inlet 78 of condenser 16. Low temperature source 76 may be, for example, engine coolant, a low temperature coolant loop, or ambient air. Finally, conduit 80 is connected between an outlet 82 of condenser 16 and, depending upon the application, the engine cooling loop, a radiator, or the atmosphere.

In system 10, boiler 12 is provided to use heat from waste heat source 54 which is passed through boiler 12 to increase the temperature of a working fluid provided to boiler 12 at high pressure. As is further described below, under certain operating conditions, the working fluid is provided to boiler 12 at inlet 44 from recuperator 22 through conduit 38. When the working fluid leaves boiler 12 at outlet 48, it is in a gaseous state, at high pressure and high temperature as a result of the heat transferred to the working fluid from waste heat source 54 passed through boiler 12. This gas is passed through conduit 46 to turbine 14 where the energy from the gas is used to produce work using techniques that are well understood in the art. For example, turbine 14 may cause rotation of a shaft (not shown) to drive a generator (not shown) for creating electrical power.

Turbine 14 does not convert all of the heat energy from the working fluid into work. Thus, the working fluid discharged from turbine 14 at diffuser outlet 64 remains in a high temperature, gaseous state (for some working fluids). As is further described below, the working fluid is passed through conduit 62 to recuperator 22 where, under certain operating conditions, it is used to transfer heat to the working fluid discharged from the condenser 16. The working fluid then passes through conduit 68 to condenser 16, where it is cooled by low temperature source 76 coupled to condenser 16. The working fluid discharged from condenser 16 though conduit 24 is in a low temperature, low pressure liquid state. As should be understood by those skilled in the art, condenser 16 is used to decrease the temperature of the working fluid for at least two reasons. First, although high temperature working fluid is desirable to obtain maximum work from turbine 14 (i.e., to obtain maximum efficiency of the Rankine cycle), the primary requirement of system 10 is to maintain the desired heat rejection from waste heat source 54 passed through boiler 12. Accordingly, a low temperature working fluid should be provided to boiler 12. Second, increasing the pressure of the working fluid in its liquid state takes substantially less energy than increasing its pressure when in the gaseous state. As such, pump 18, which provides this pressure increase, may be less robust and less expensive than would otherwise be required for a gas pump.

The working fluid at outlet 32 of pump 18 is provided through conduit 30 to inlet 36 of recuperator 22 and inlet 34 of bypass valve 20. As will be further described below, under high load engine operating conditions, bypass valve 20, which is controlled by controller 63, is moved to an opened position, passing at least some of the low temperature working fluid directly to boiler 12. Under partial load engine operating conditions, which constitute the normal engine operating conditions, bypass valve 20 is moved to a closed position, thereby permitting the low temperature working fluid to flow through conduit 30 to recuperator 22. As described above, recuperator 22 provides heat transfer from the high temperature discharge gas from turbine 14 to the low temperature liquid provided by pump 18. This heat transfer increases the temperature of the working fluid (which remains in a liquid state) provided to boiler 12. Of course, higher temperature working fluid does not cool the waste heat streams passing through boiler 12 as effectively as cooler working fluid, but under most operating conditions, the heat rejection provided by the higher temperature working fluid is satisfactory. Moreover, because the working fluid enters boiler 12 at an elevated temperature, the working fluid provided from boiler 12 to turbine 14 (in a gaseous state) is at a higher energy state than it would otherwise be had recuperator 22 not been used. This provides greater energy to turbine 14, which consequently can generate a greater work output.

As indicated above, system 10 should be designed to operate over a wide range of conditions. For purposes of system 10, the operating conditions are primarily reflected by the temperature and pressure of waste heat provided to boiler 12. When waste heat source 54 is part of an EGR loop, the waste heat discharge 58 must not be permitted to exceed a maximum threshold temperature. In some applications, the outlet temperature of the waste heat flowing through conduit 58 from boiler 12 must be low enough to enable the engine to meet emission requirements imposed on the engine. If the required engine waste heat stream cooling is not met (if it is charge air, engine coolant or EGR gases) the engine will be non-compliant with emission regulations. If the waste heat stream is exhaust gas, this is not an issue because exhaust gas that is expelled out the exhaust stack is not required to be cooled.

Under ordinary engine load conditions, the low temperature working fluid from condenser 16 provides more than enough cooling to the waste heat passed through boiler 12. Accordingly, under normal load conditions, the working fluid is passed through recuperator 22 which both reduces the temperature of the working fluid provided to condenser 16 and increases the temperature of the working fluid provided to boiler 12. More specifically, as gaseous working fluid passes through a first flow path of recuperator 22 from inlet 66 to outlet 70, it transfers heat to the lower temperature liquid working fluid passing though a second flow path from inlet 36 to outlet 40. As a result, the gaseous working fluid provided to condenser 16 is cooler, and easier for condenser 16 to condense to liquid. Also, the liquid working fluid provided to boiler 12 is at a higher temperature. Consequently, the gaseous working fluid provided to turbine 14 after heating in boiler 12 is at a higher energy state than it would otherwise be if recuperator 22 were not in the cycle. While less heat is removed from the waste heat, under normal load conditions, the waste heat temperature is nonetheless maintained below the maximum threshold. Thus, system 10 can accommodate the added heat provided by recuperator 22 and realize greater efficiency because the added heat permits turbine 14 to create more useful work.

When the engine load increases (e.g., during acceleration, uphill driving, when pulling a heavy load, etc.), more, higher temperature waste heat is provided to boiler 12. As described above, in engine systems where waste heat source 54 is in an EGR loop, engine coolant loop, or charge air loop, for example, boiler 12 must extract enough heat from the waste heat to ensure that it remains below the maximum threshold. As such, system 10 is designed to sense the increased load conditions and activate bypass valve 20 to direct working fluid directly from condenser 16 (though pump 18) to boiler 12. In the depicted embodiment of the present invention, sensor 61 senses the waste heat temperature flowing though conduit 58. Sensor 61 provides an output signal indicative of the temperature of this waste heat to controller 63. Controller 63 includes electronics (not shown) which interpret the output signals from sensor 61 to determine the engine load level. When the load level reaches a predetermined level, as indicated by sensor 61, controller 63 causes bypass valve 20 to open partially, thereby directing some of the cooler working fluid flowing though conduit 30 directly from pump 18 to boiler 12. As the engine load increases, controller 63 further opens bypass valve 20 to direct more cooler working fluid directly to boiler 12 (i.e., bypassing recuperator 22). The system is designed such that when bypass valve 20 is fully opened, enough cooler working fluid is provided to boiler 12 to prevent the waste heat exiting boiler 12 from exceeding a predetermined maximum temperature.

It should be understood that other control systems may be employed to sense engine load and control bypass valve 20. For example, one skilled in the art can readily envision a predictive control system wherein engine load is monitored more directly, and bypass valve 20 is adjusted based on the expected temperature of the waste heat stream exiting boiler 12. In this configuration, the system anticipates the thermal lag experienced in the heat exchangers resulting from changes in engine operating conditions.

As a result of the bypassing described above, under increasing load conditions at least a portion of the working fluid is not passed through recuperator 22 where its temperature would be elevated prior to entering boiler 12. The working fluid flow rate is reduced compared to what the flowrate would have been without the recuperator bypass valve in the system under these conditions because the heat input from recuperator 22 is removed. Higher temperature gases discharged from turbine 14 are then cooled by condenser 16. This results in higher pressure at condenser 16, a lower pressure ratio at turbine 14, and a correspondingly lower power output of turbine 14. In other words, the efficiency of system 10 is reduced because the condenser 16 must cool the working fluid discharged from turbine 14 without the benefit of recuperator 22 cooling the working fluid, and because the working fluid provided turbine 14 from boiler 12 is not pre-heated by recuperator 22. As the high load conditions occur for only a relatively small percentage of the engine's operating time (e.g., five to ten percent), this loss in efficiency is acceptable.

As should be apparent from the foregoing, system 10 may be designed for efficient operation at the most common operating point (i.e., normal engine load conditions) as the recuperator 22 bypass feature permits system 10 to accommodate the peak heat rejection requirements that occur under high load conditions. As such, a lower power turbine 14 may be selected. More specifically, if bypass valve 20 were not included in system 10, turbine 14 would be required to withstand the high load operating conditions described above, even though those high load conditions occur relatively infrequently. This would require a more robust, more expensive turbine 14 (e.g., a maximum output of 35 KW), which would be essentially under-utilized most of the time (i.e., under normal load conditions). By implementing the bypass feature described above, a less robust, less expensive turbine 14 may be used (e.g., a maximum output of 25 KW).

Additionally, by placing bypass valve 20 at the output of pump 18 rather than on the high temperature side of system 10, bypass valve 20 may be designed for operation with a lower temperature liquid rather than a high temperature gas. Accordingly, bypass valve 20 may be more compact, simpler, and less expensive than would otherwise be required. Moreover, the flow rate and power of pump 18 may be lower than would otherwise be required.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A waste heat recovery system containing a working fluid for converting waste heat from a waste heat source of an engine into usable work while maintaining a temperature of the waste heat below a predetermined maximum value, the system including:

a recuperator configured to add heat to a low pressure side of a Rankine cycle including a heat conversion device, a condenser, a pump, and a boiler, said recuperator receiving working fluid gas flowing to the condenser and working fluid liquid from the condenser to transfer heat from the gas to the liquid;

means for bypassing the recuperator when the engine is operating under high engine load conditions to maintain the waste heat temperature below the predetermined maximum value; and means for controlling the bypassing means in response to an output from means for sensing the high engine load conditions.

2. The system of claim 1 wherein the bypassing means includes a valve coupled between an outlet of the pump and an inlet of the boiler in parallel with the recuperator.

3. The system of claim 1 wherein the waste heat source is an EGR loop.

4. The system of claim 1 wherein a maximum power of the turbine heat conversion device corresponds to normal load conditions of the engine.

5. A waste heat recovery system to recover waste heat from an engine, including:

a recuperator configured to cool gas provided through a first flow path of the recuperator from a heat conversion device to a condenser and to heat liquid provided through a second flow path of the recuperator from the condenser to a boiler;

a valve connected in parallel with the second flow path and having an opened position for bypassing the second flow path;

a sensor to at least one of detect and monitor an engine operating condition indicative of engine load conditions and generate an output signal based on said operating condition; and a controller coupled to said valve and said sensor, said controller being configured to place the valve in the opened position under high engine load operating conditions.

6. The system of claim 5 wherein the heat conversion device is a turbine configured to convert high temperature gas from the boiler into motive work.

7. The system of claim 5 wherein the boiler extracts heat from a waste heat source of a diesel engine.

8. The system of claim 7 wherein the valve is moved to the opened position to maintain a temperature of waste heat from the waste heat source below a predetermined maximum temperature.

9. The system of claim 8 wherein the waste heat source is exhaust gas circulating in an EGR loop.

10. The system of claim 5 wherein the valve is in a closed position under normal engine load operating conditions, thereby causing the liquid to flow through the second flow path.

11. The system of claim 5, further including a pump coupled to an output of the condenser and configured to increase the pressure of the liquid leaving the condenser.

12. A system for converting waste heat from an engine into work, including:

a boiler coupled to an engine waste heat source for transferring heat to a working fluid;

a heat conversion device configured to receive the working fluid from the boiler and to transform heat in the working fluid into motive work;

a condenser coupled to a low temperature source for transforming working fluid in a gaseous state into working fluid in a liquid state;

a recuperator having a first flow path that routes gaseous working fluid from the heat conversion device to the condenser, and a second flow path that routes liquid working fluid from the condenser to the boiler, the recuperator being configured to transfer heat from the gaseous working fluid to the liquid working fluid; and a bypass valve coupled between the condenser and the boiler in parallel with the second flow path, the bypass valve being movable between a closed position under normal engine load conditions, thereby permitting working fluid to flow through the second flow path instead of the bypass valve and an opened position under high engine load conditions, thereby permitting at least a portion of the working fluid to flow from the condenser to the boiler without flowing through the second flow path;

a sensor to at least one of detect and monitor an engine operating condition indicative of engine load conditions and generate an output signal based on said operating condition; and a controller coupled to the sensor and the bypass valve, the controller causing the bypass valve to move toward the closed position when the output signal from the sensor indicates normal engine load conditions and causing the bypass valve to move toward the opened position when the sensor output signal indicates high engine load conditions.

13. The system of claim 1 wherein the bypass valve is moved to the opened position to maintain a temperature of the waste heat below a predetermined maximum temperature.

14. The system of claim 1 wherein the waste heat source is one of an EGR gas, engine coolant and charge air.

15. The system of claim 1, further including a pump coupled to an output of the condenser and configured to increase the pressure of the liquid working fluid provided to the bypass valve and the recuperator.

16. The system of claim 1, wherein said sensor is configured to sense a temperature of waste heat exiting the boiler, wherein the waste heat temperature is indicative of the engine load conditions.

* * * * *